United States Patent [19]

Bassett

[11] 4,222,554

[45] Sep. 16, 1980

[54] ELECTRIC SALT BATH FURNACE

[75] Inventor: Leslie Bassett, Mount Clemens, Mich.

[73] Assignee: Upton Industries, Inc., Roseville, Mich.

[21] Appl. No.: 966,926

[22] Filed: Dec. 6, 1978

[51] Int. Cl.[3] ..... C21D 1/46

[52] U.S. Cl. ..... 266/120; 266/128; 266/130

[58] Field of Search ..... 266/120, 128, 130; 13/6, 18 R, 23

[56] References Cited

U.S. PATENT DOCUMENTS

| | | | |
|---|---|---|---|
| 957,337 | 5/1910 | Hixon | 13/23 |
| 1,013,189 | 1/1912 | Louvrier | 13/23 |
| 2,213,138 | 8/1940 | Hayward | 175/41 |
| 2,249,993 | 7/1941 | Upton | 13/24 |
| 2,355,761 | 8/1944 | Upton | 13/23 |
| 2,464,008 | 3/1949 | Upton | 75/11 |
| 2,820,075 | 1/1958 | Upton | 13/23 |
| 3,049,576 | 8/1962 | Upton | 266/120 |
| 3,085,124 | 4/1963 | Upton | 13/23 |
| 3,128,327 | 4/1964 | Upton | 13/33 |
| 3,398,228 | 8/1968 | Blumenfeld | 13/6 |
| 3,420,937 | 1/1969 | Upton et al. | 13/9 |
| 3,770,501 | 11/1973 | Kemper | 134/19 |
| 4,149,022 | 4/1979 | Hrycik | 13/6 |

*Primary Examiner*—L. Dewayne Rutledge
*Assistant Examiner*—John P. Sheehan
*Attorney, Agent, or Firm*—Cullen, Sloman, Cantor, Grauer, Scott & Rutherford

[57] ABSTRACT

In the art electric heat treat furnaces have a frame and an open top housing of refractory brick therein including a plurality of inner walls defining a chamber throughout its height adapted to receive a molten bath such as a salt bath into which metal pieces are suspended for heat treatment. The chamber has a top entrant passage of rectangular shape. Electrodes extend transversely through the housing adjacent the chamber for the passage of current through the bath between the electrodes to maintain the bath at a predetermined heat treat temperature. A transformer having primary and secondary pads includes electric connectors between the pads and the electrodes. The improvement herein comprises a plurality of vertically spaced tiers of vertically spaced electrodes arranged along the height of the chamber. At least one and, in some cases, a pair of spaced inner walls of the housing are laterally displaced outwardly of the entrant passage to provide a heat treat chamber which is laterally enlarged adjacent such displaced inner wall thereby spacing the electrodes laterally outward of the entrant passage and outward of the chamber. Thus, the workpieces to be treated may extend to the bottom of the chamber, the tiers of electrodes maintaining a substantially uniform temperature of the bath throughout the depth of the bath. The entrant passage serves to space the workpieces inwardly of the electrodes so as not to obstruct the current flow between such electrodes. A modification includes additional vertically spaced tiers of vertically spaced electrodes laterally spaced from the corresponding first mentioned tiers of electrodes.

9 Claims, 18 Drawing Figures

ELECTRIC SALT BATH FURNACE

BACKGROUND OF THE INVENTION

Electric heat treat furnaces employing molten salt baths within which workpieces may be suspended for heat treatment are known and wherein, the pairs of electrodes employed are normally emersed within the bath adjacent the bottom of the chamber. These are ineffective in maintaining a uniform temperature throughout the depth of the bath. This is particularly true as heat treat baths increase in depth. There is a limit to which heat convection from electrodes spaced near the bottom of such bath will be effective for providing uniform heat treat temperatures throughout the height of the bath.

Heretofore, variations in temperature have exceeded 75 degrees F. between top and bottom in typical 80-inch deep baths. There has, therefore, existed the problem of maintaining a substantially uniform temperature throughout the depth of the bath to provide for uniform heat treatment of workpieces suspended therein.

Heretofore, in old salt bath designs, the entrant opening has been maintained as small as possible in order to minimize radiation losses. Hence the bath has been made deeper normally so that the work is arranged above the current electrode paths. In cases where too deep a bath is required, the bath has been made wider so that the full bath depth can be utilized at the expense of increased radiation losses.

Heretofore, there has been another problem in the placement of electrodes such that, it has not been possible for workpieces to occupy the full dimensions of the bath laterally and longitudinally without obstructing a portion of the electron bath between electrodes.

Examples of prior art patents related to the present heat treat furnace may be found in the following U.S. Pat. Nos. 2,355,761, 3,049,576, 3,128,327, 3,420,937, 3,085,124, 2,464,008, 2,213,138, 2,820,075, 3,770,501, and 2,249,993.

SUMMARY OF THE INVENTION

It is a feature of the present invention to overcome some of the difficulties above enumerated with respect to prior art, electric heat treat furnaces with salt or other baths and to provide a plurality of vertically spaced tiers of vertically spaced electrodes arranged along the height of the chamber of the housing for the bath and to, therefore, provide for a substantially uniform bath temperature throughout the depth thereof.

It is a further feature to provide a chamber for receiving a molten salt bath or the like within a refractory or ceramic housing and wherein, one or more of the walls defining the chamber are laterally displaced outwardly of the entrant passage to the chamber and wherein, a plurality of vertically spaced tiers of vertically spaced electrodes are nested within the housing walls laterally outward of the entrant passage and outwardly of the chamber to thereby provide for maximum utilization of the full height of the chamber by workpieces extending to the bottom thereof and for maximum utilization of the width of the chamber governed by the width of the entrant opening to the chamber and with such spacing of the electrodes outwardly thereof that maximum length and width of workpieces suspended within the bath do not interfere with current paths between adjacent vertically spaced electrodes.

It is a further feature to provide an electric salt bath furnace and wherein, the housing defining the molten salt bath chamber has a reduced size entrant opening relative to the dimensions of the chamber to minimize heat radiation loss.

These and other objects will be seen from the following specification and Claims in conjunction with the appended drawings.

THE DRAWINGS

Figure 1:
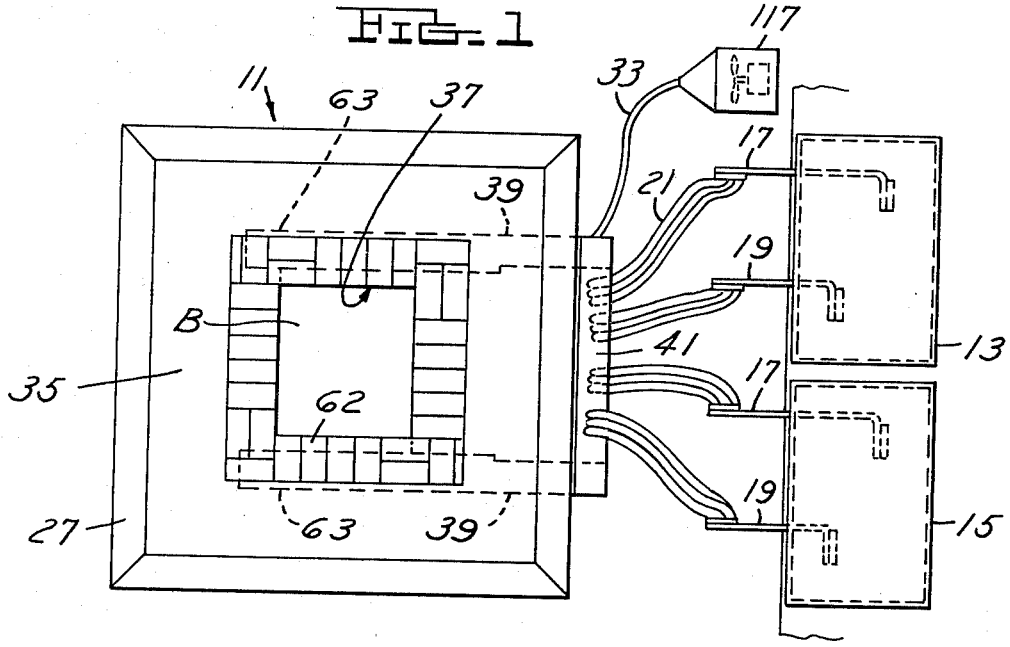
FIG. 1 is a plan view of the present heat treat furnace with the transformers and connections shown schematically.

It will be understood that the above drawings illustrate merely preferred embodiments of the invention, and that other embodiments are contemplated within the scope of the Claims hereafter set forth.

DETAILED DESCRIPTION OF THE INVENTION

Referring to the drawings, FIGS. 1 and 2, the present electric heat treat or salt bath furnace is generally indicated at 11 nested within pit P spaced below floor surface F, FIG. 2. Transformer 13, for example, 80 kw, primary 230 volts, secondary 28 to 48 volts, is mounted and supported upon the floor surface F. The second transformer 15, for this embodiment, is also 80 kw, primary rated 198 volts, the secondary 28 to 48 volts. Each transformer 13, 15 has primary and secondary pads to which are joined the connectors or bus bars 17 and 19 respectively, FIGS. 1 and 2.

Flexible conductors or leads 21 extend from the respective connectors 17 and 19 adapted for connection to the electrodes 39 hereafter described.

The electric heat treat furnace 11 includes a hollow open top frame 27 having outer wall 23, base 25 and an open top. The frame 27 also includes corner reinforcements 29 and center reinforcing band 31.

Figure 2:
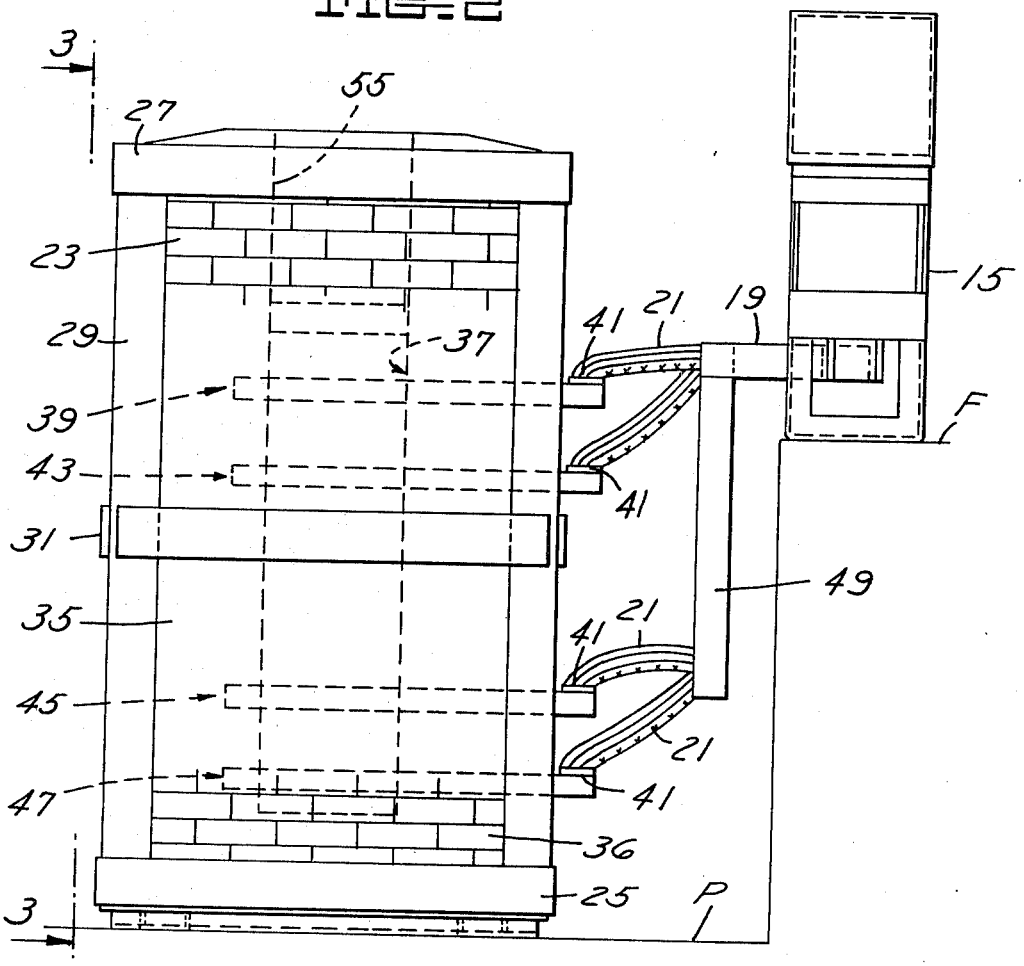
FIG. 2 is a side elevational view thereof.

Refractory or ceramic brick housing 35 is enclosed within the frame 27 and extends throughout its height, as shown in FIG. 2. The housing 35 has a base 36 mounted upon the base 25 of the hollow frame 27.

Housing 35 has a central upright chamber 37 for holding a molten bath B, which may be a salt bath, for example, and which in the illustrative embodiment, has a depth of 90 inches, for illustration only.

As shown in FIGS. 1 through 4, a first pair of laterally opposed spaced electrodes 39 laterally interconnected by bus bar 41 upon the exterior of frame 27, project transversely through the opposed walls of the housing 35 adjacent chamber 37 upon opposite sides thereof. Bus bar 41 is connected to the secondary pad of transformer 13 by the flexible connector 21 and bus bar 17. A second pair of laterally spaced electrodes 43 is spaced below electrodes 39 and are interconnected by a bus bar 41 upon the exterior of the frame 27, and project laterally through corresponding walls of the housing 35 with their inner edges adjacent the bath chamber 37. The bus bar 41 for the electrodes 43 is connected to the primary pad of the transformer 13 by corresponding series of connectors 21 and bus bar 19.

A third laterally opposed pair of electrodes 45 also interconnected by bus bar 41 upon the exterior of the frame 27 project transversely through the opposed walls of the refractory or ceramic housing 35 adjacent chamber 37. The connecting bus bar 41 is connected by conductors 21 to the corresponding bus bar 49 leading to the secondary pad of transformer 15.

A fourth pair of laterally opposed electrodes 47 is spaced below the laterally opposed pairs of electrodes 39, 43, and 45 and are interconnected by a bus bar 41, extend transversely through opposed side walls of the refractory housing 35 closely adjacent the bath chamber 37. The interconnecting bus bar 41 between the electrodes 47 is connected by flexible connector 21 and bus bar 49-19 to the corresponding primary pad of the second transformer 15.

In the illustrative embodiment, the electrodes are constructed of solid chrome and fire vertically with respect to the next vertically spaced adjacent electrode. There is, thus, provided upon and within opposite side wall portions of housing 35 tiers of vertically spaced electrodes 39–43 and 45–47, with the respective electrodes in each tier being laterally opposed to corresponding vertically spaced tiers of electrodes upon the opposite side of the housing 35.

Figure 6:
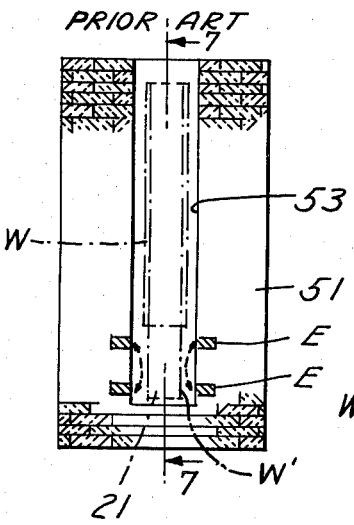
FIG. 6 is a view similar to FIG. 4 illustrating a prior art heat treat furnace and taken in the direction of arrows 6—6 of FIG. 7.
Figure 7:
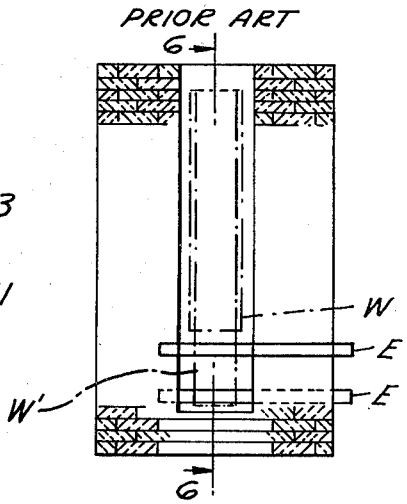
FIG. 7 is a similar view of a prior art heat treat furnace taken in the direction of arrows 7—7 of FIG. 6.

FIGS. 6 and 7 are illustrative of the prior art and wherein, the central ceramic bath housing 51 has a central upright chamber 53 of rectangular cross section, and uniform in dimensions throughout its height. Adapted for storing within the chamber 53 is a suitable salt or other bath within which the workpiece loads W and W′ are suspended for heat treatment.

Accordingly, in the prior art constructions, narrower and shorter work loads W and W′ could be treated in the heat treat baths within the chambers 53 of such ceramic housings.

Figure 3:
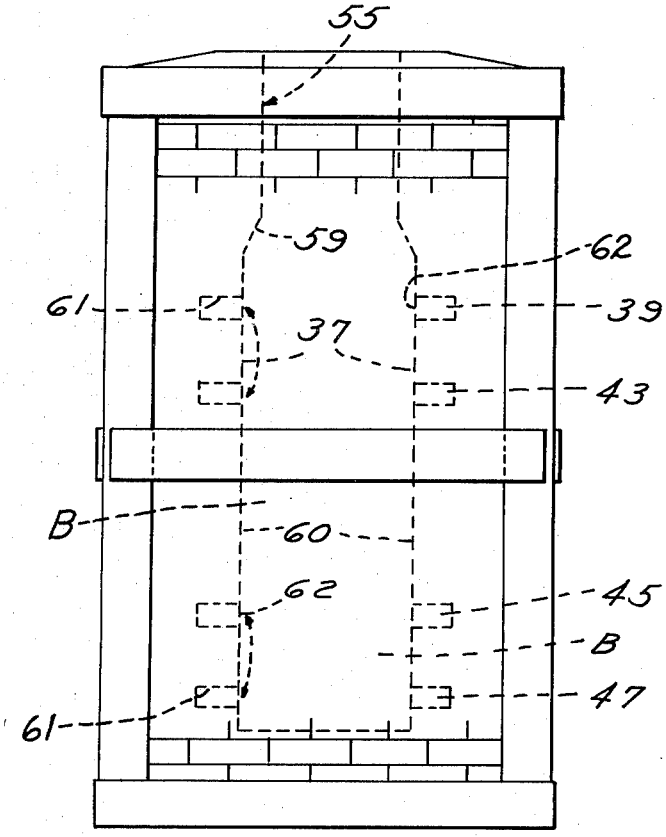
FIG. 3 is a front elevational view thereof taken in the direction of arrows 3—3 of FIG. 2.
Figure 5:
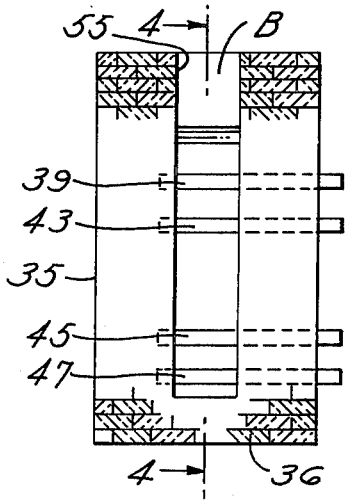
FIG. 5 is a vertical section taken in the direction of arrows 5—5 of FIG. 4.

Referring to FIGS. 1 through 4 in the present improved electric heat treat furnace 11, there is provided an entrant opening or passage 55 which is rectangular in cross section such as 16 by 18 inches, for illustration only. The entrant passage 55 is defined by pairs of opposed upright side walls. The entrant passage 55 extends into the main upright chamber 37 which, in one direction, is laterally enlarged as shown in FIG. 3 and which is defined by opposed pairs of upright spaced interior side walls 60.

As shown in FIG. 3, at least a pair of the side walls which define the entrant passage 55 terminate at their lower ends in downwardly and outwardly tapered portions 59 merge with corresponding pair of opposed spaced side walls 60 which define the ends of the salt bath chamber 37. In the illustrative embodiment, a pair of the opposed side walls 60 are laterally displaced outwardly with respect the corresponding walls of the entrant passage 55 so that, in effect, the heat treat chamber 37 at least in one dimension is increased laterally with respect to the corresponding dimension of the entrant passage 55.

As shown in FIG. 3, the respective opposed pairs of electrodes 39, 43, 45 and 47 are snugly nested within opposed undercut pairs of channels 61 formed within the corresponding side walls 60 of the ceramic bath housing 35. Accordingly, the respective electrodes are arranged laterally outward of the bath B with their inner upright surfaces 62 in registry therewith and in registry with the walls 60 defining the corresponding sides of the bath, B as best shown in FIG. 3.

In the illustrative embodiment, the adjacent pairs of electrodes 39–43 and 45–47 fire vertically as designated by the arrows which are shown as defined within the laterally displaced portions of chamber 37.

Figure 4:
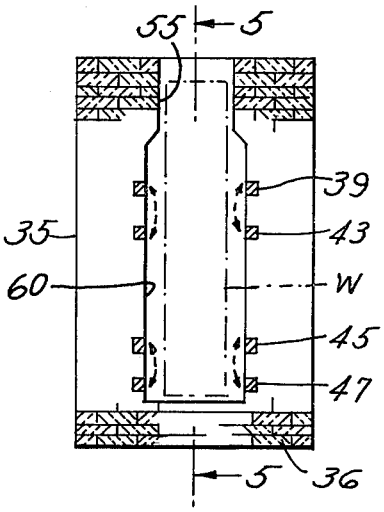
FIG. 4 is a fragmentary vertical section of the heat treat furnace shown in FIG. 2, on a reduced scale, and taken in the direction of arrows 4—4 of FIG. 5.

As shown in FIG. 4, the current paths between the respective vertically spaced tiers of vertical pairs of electrodes permit a workpiece load W of maximum dimensions in diameter and length. The workpiece load, therefore, has a dimension corresponding substantially to the dimensions of the entrant opening or passage 55 and this dimension may extend throughout the height of the bath chamber 37 because a pair of the corresponding side walls 60 which define the bath chamber 37 have been laterally displaced outwardly of the entrant passage 55 a distance of 2 to 4 inches, for example.

Thus, the corresponding vertically spaced pairs of electrodes are likewise laterally spaced with respect to chamber 37. Accordingly, the workpiece load W does not interfere with the respective current paths shown by the arrows between the respective vertically spaced electrodes of the respective tiers. For this reason, the workpiece loads W normally suspended from the top of the housing 35, extend substantially to the bottom of the bath or chamber 37.

Figure 8:
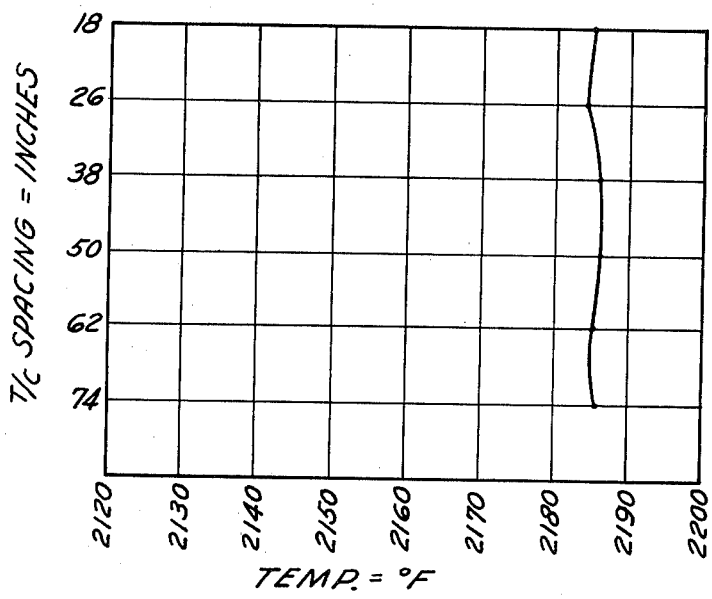
FIG. 8 is a heat uniformity graph corresponding to the conditions produced by the improved heat treat furnace shown in FIGS. 1, 2 and 3.
Figure 9:
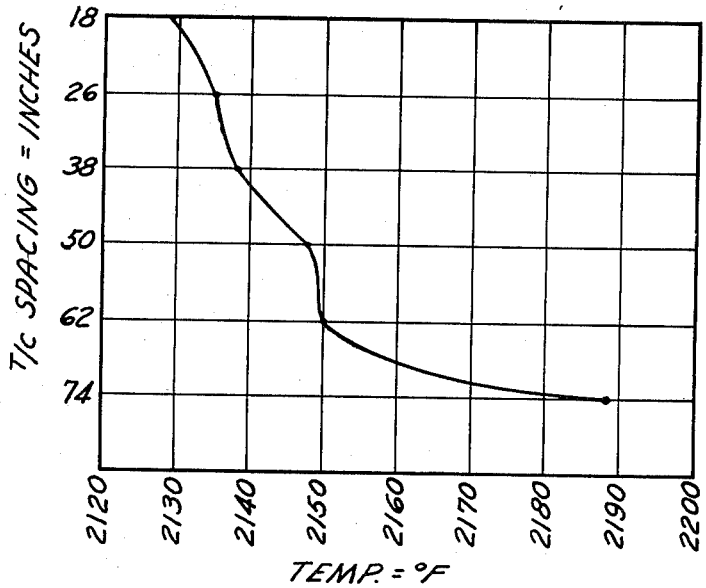
FIG. 9 PRIOR ART
FIG. 9 is a similar graph showing variable heat gradient from the prior art heat treat furnaces shown in FIGS. 6 and 7.

Additionally, as has been found by experimentation, the arrangement of vertically spaced tiers of vertical electrodes along the height of the chamber 37 will maintain a substantially uniform temperature gradient of the molten bath, throughout substantially the height of the chamber 37 as best shown in heat uniformity graph, FIG. 8. Here, it is shown that the bath temperature of approximately 2,185 degrees F. is uniform throughout the height of the chamber plus or minus 2–5 degrees F.

This is achieved by the use of the vertically spaced tiers of electrodes 39, 43, 45 and 47 arranged and spaced along the length of the refractory housing 35 intermediate its height and arranged upon opposite sides of the bath chamber 37.

As shown in FIGS. 1 through 4, in the illustrative embodiment, the vertically spaced tiers of electrodes are arranged upon opposite sides of and outwardly of the opposed pair of laterally spaced side walls 60 which define one cross sectional dimension of heat treat chamber 37.

In the illustrative embodiment, a pair of transformers 13 and 15 are employed so that they may be individually controlled in such a manner that the correct amount of power is applied to the respective bus bars 41 of each of the vertically spaced pairs of electrodes in the corresponding vertically spaced tiers upon opposite sides of the heat treat chamber 37.

As shown in FIG. 1, the respective electrodes 39, 43, 45 and 47 extend transversely through portions of opposed walls of housing 35. The electrodes are air-cooled such as by the blower 117 or other air moving means connected to the electrodes at 33.

By this construction, the electrodes are air cooled instead of water cooled as has been conventional in the prior art. This results in a saving of 1½ gallons of water per minute per electrode which is either run down the sewer or recirculated through an expensive water-circulating system in the prior art. This provides for an extended electrode life because the electrodes stay warmer and, therefore, do not work as hard to maintain the furnace bath at a uniform temperature. Cooling holes do not plug up as they would with water cooling due to the presence of lime or iron in the water, which is usually the only water available to plants using well water, for illustration. No contaminated water is discharged into sanitary sewers. No elaborate and expensive plumbing system is required, as is necessary for water-cooled electrodes. Air cooling avoids the use of large amounts of water, normally not available in rural areas, particularly where city water supply is not available. The present air-cooling system for the electrodes eliminates the possibility of plumbing failures due to ruptured pipes or hoses which could cause water to come into contact with the molten salt of the bath, creating a safety hazard.

Where several heat treat furnaces are employed, one common header may be provided for supplying circulating cooling air to one or several furnaces and to the electrodes with a small pressure blower for each conduit to a heat treat furnace such as shown schematically at 117, FIG. 1. The air cooling arrangement for the electrodes, thus, produces considerable savings in installation costs. A typical water saving on one furnace with four electrodes and four water circuits at 1½ gallons water per circuit would be 360 gallons per hour, 8,640 gallons per day and 3,153,600 gallons per year.

In old salt bath designs, it was recognized advisable to keep the top bath area as small as possible in order to minimize radiation losses. Accordingly, the baths were made deeper so that the work would be arranged above the electrode current path. If this necessitated making too deep a bath, the bath could be made wider so that full bath depth could be utilized, but this at the expense of increased radiation losses, as shown in the prior art illustrations, FIGS. 6 and 7.

In the present design, the bath area at the top is kept at a minimum in view of the reduced size entrant passage 55 to minimize radiation losses. The inner bath walls 60 are stepped out, as shown in FIG. 3 so that the work W is clear of the electrode current paths. This enables one to take advantage of full bath area and depth without incurring increased radiation losses.

The electrodes 39, 43, 45 and 47 are arranged in vertically spaced tiers along opposed side walls 60 of the bath chamber 37.

A uniform bath temperature is achieved in larger and wider and deeper baths by the vertically spaced tiered sets of electrodes which are very carefully arranged along the length of the bath chamber intermediate its ends. This provides for a substantially uniform temperature throughout the height of the bath, as best illustrated in the heat uniformity graph shown in FIG. 8.

MODIFICATION

Figure 10:
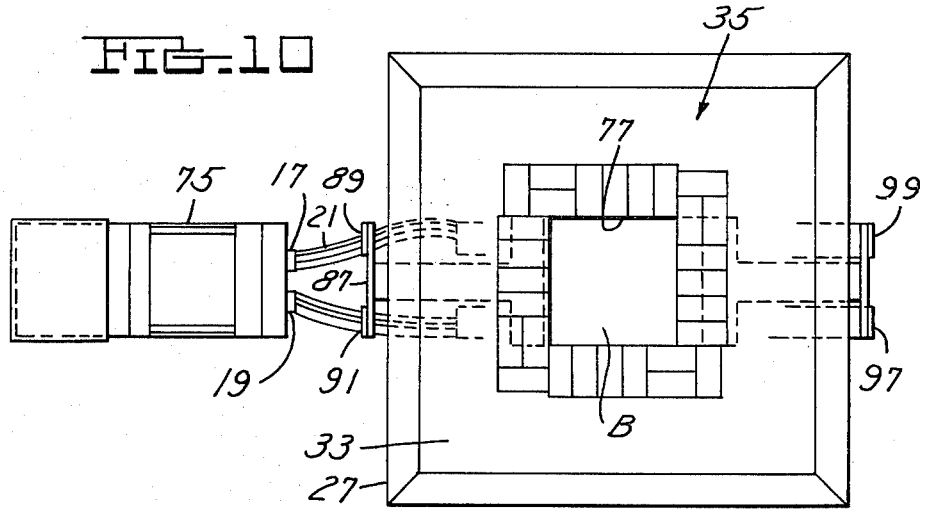
FIG. 10 is a plan view of a modified heat treat furnace employing a single transformer.
Figure 11:
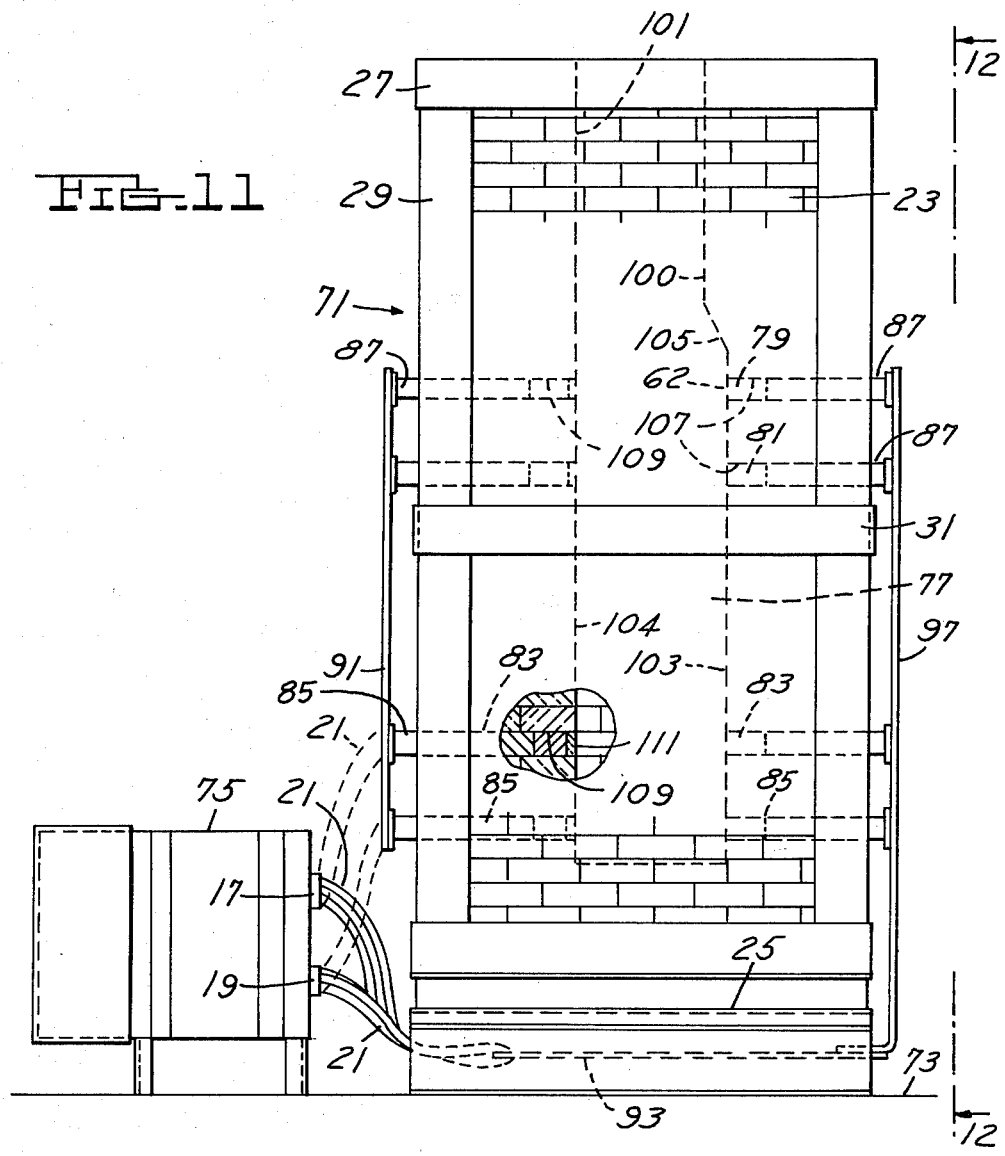
FIG. 11 is a side elevational view thereof.
Figure 13:
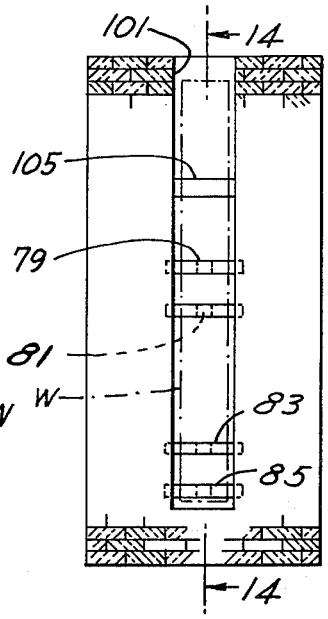
FIG. 13 is a fragmentary view of the heat treat furnace of FIG. 11, on a reduced scale, and taken in the direction of arrows 13—13 of FIG. 14.

A modified electric heat treat furnace is shown in FIGS. 10, 11 and 13 which construction is quite similar to that shown in FIGS. 1, 2, 3 and 4, and to the extent that the structures involved are the same, a repetition of the description thereof is omitted. Corresponding numerals are applied to the illustrations in FIGS. 10, 11 and 13 for the common elements between the modification and the first-described embodiment.

The modified electric heat treat furnace has an open top frame 27 enclosing the open top ceramic brick housing 35 having an upright chamber 77 therein of rectangular shape in cross section for receiving salt bath B. The open top refractory brick housing 35 is nested within the open top frame 27 and the electrodes herein described are similarly air cooled.

In the modified electric heat treat furnace, the frame base 25 is mounted upon platform 73, which could be a floor surface or a pit bottom. The corresponding transformer 75 which includes primary and secondary pads is similarly mounted upon platform 73.

Housing 35 of refractory brick includes a plurality of opposed inner walls which define chamber 77 for receiving the salt bath B.

A laterally opposed pair of spaced conductive electrodes 79 of T-shape extend through an opposed pair of walls of housing 35 on opposite sides thereof arranged adjacent the corresponding side walls of chamber 77 and outwardly thereof.

A second pair of laterally opposed electrodes 81 of T-shape similarly project through opposed walls of the housing 35 and are spaced below the first opposed pair of electrodes 79. The opposed pairs of electrodes 79 and 81 are arranged in tiers upon opposite sides of housing 35 adjacent and outwardly of the interior walls thereof defining the bath chamber 77.

A third pair of opposed T-shaped electrodes 83 are spaced below the electrodes 81 and are arranged upon opposite sides of the housing 35 adjacent and outwardly of chamber 77.

A fourth pair of laterally opposed T-shaped electrodes 85 are spaced below electrodes 83 and extend through opposed walls of the ceramic housing 35 upon opposite sides of the chamber 77.

Since the respective electrodes are of T-shape, each includes a transverse arm which is nested within a corresponding channel or recess within the opposed walls of the housing 35 with the respective right-angularly related leg thereof projecting transversely outward having connectors 87. These are joined to the respective bus bars 89 and 91 upon one side of the frame 27 outwardly thereof and to the additional pair of laterally spaced bus bars 97 and 99 upon the opposite side of the frame 27 outwardly thereof, as best shown in FIGS. 10 and 11.

In the illustrative embodiment, a single transformer 75 is employed having primary and secondary conventional pads, since only one set of tiered electrodes is used at one time.

For illustration, the primary pads terminate in the bus bar 17 and the secondary pads terminate in the bus bar 19, FIG. 11. The flexible conductors 21 from the primary pads of the transformer 75 extend to the upright bus bar 91 joined by connections 87 to the upper laterally opposed pairs of electrodes 79 and 83 of the vertically spaced tiers of electrodes upon the left side of the frame 27 shown in FIG. 11. An additional flexible connector 21 extends from the primary bus bar 17 and is joined to one of the laterally spaced connectors 93 which connects one of the respective upright bus bars 97 and 99 upon the opposite side of the frame 27 and which are joined respectively by suitable connections 87 to the corresponding electrodes 79 and 83 upon the opposite side of the ceramic housing 35. Accordingly, the primary pad or bus bar 17 from transformer 75 is connected to the upper of the vertically spaced tiers of electrodes upon opposite sides of the ceramic housing 35.

By similar construction, the secondary pad or bus bar 19 from the transformer utilizing flexible conduit 21, and the other upright bus bar 89 provide connection to the lower opposed pairs of electrodes 81 and 85 upon one side of the housing 35. Additional flexible connectors 21 through the other of the pair of bus bars 93 and 95 connect to the other of the upright bus bars 97 and 99 so as to provide electrical connection to the lower pair of laterally opposed electrodes 81 and 85 upon the opposite side of the ceramic housing 35.

In the modified heat treat furnace, there is provided an entrant opening 101 which is rectangular in cross section and from which are normally suspended the workpiece load W for projecting down into the bath B and which extends substantially throughout the depth of the bath as shown in FIG. 13. This distinguishes from the prior art illustrations of the ceramic housing shown in FIGS. 15 and 16, wherein the work loads W and W' are either of reduced diameter or of less height, as loaded within the bath and wherein, the electrodes are arranged adjacent the base of the bath.

The respective electrodes 79, 81, 83 and 85 are arranged in opposed pairs and spaced along the height of the refractory housing 35 and are nested within undercut channels 107 and 109 and formed through the opposed walls of the housing 35.

One of the opposed side walls 100 which defines the entrant passage 101 for the salt bath terminates at its lower edge in the outwardly and downwardly tapered wall portion 105, FIG. 11, which merges with an upright side wall 103 defining chamber 77. Wall 103 is laterally displaced from wall 100 of the entrant passage 101 a distance of 2 to 4 inches, for example. This laterally enlarges the chamber 77 adjacent that wall to provide for increased width and length of work load pieces W, FIG. 13.

In the first embodiment, FIGS. 1 and 2, there were a pair of opposed laterally displaced side walls 60 defining the bath chamber 37. In the illustration shown in FIG. 11, only one of the side walls 103 of the chamber has been laterally displaced with respect to the entrant passage 101. The corresponding undercut channels 107 are arranged so that the inner upright edges 62 of the respective electrodes are in registry with the corresponding laterally displaced wall 103 and in registry with the salt bath B within chamber 77.

The corresponding undercut channels 109 upon the opposite side of the housing 35 are laterally displaced with respect to the corresponding wall 104 defining the chamber 77. The wall 104 itself is not laterally displaced, however, due to the lateral displacement of the transverse channels 109, the corresponding electrodes are laterally displaced from the interior wall 104. Ceramic strips 111, FIG. 11, overly the outer edge portions of the respective electrodes 79, 81, 83 and 85 and extend to the interior surface of the corresponding wall.

When and if the tiers of electrodes on the right side of the furnace, FIG. 11, are worn out, or disconnected, strips 111 are removed in order to expose the adjacent electrodes.

Figure 12:
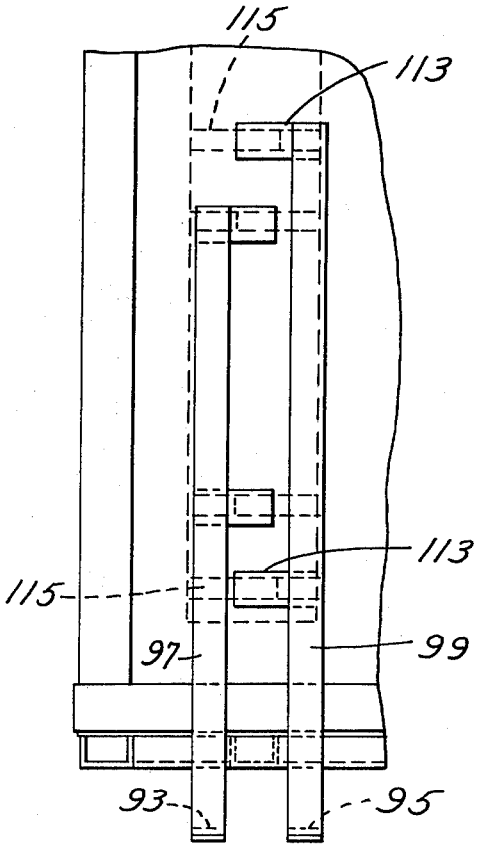
FIG. 12 is a fragmentary elevational view taken in the direction of arrows 12—12 of FIG. 11.

In the illustrative embodiment shown in FIG. 12, there is provided a means for supporting the respective bus bars 97 and 99 which are joined respectively to the corresponding transverse bus bars 93 and 95 upon the base portion of frame 27. Accordingly, in the illustrative embodiment, the respective sockets 113 extend laterally inward from the respective bus bars 97 and 99 and are supportably received by the transverse insulators 115 which extend from a rear wall portion of the frame 27. A similar mounting may be employed for upright bus bars 89 and 91.

By the construction shown in the modification, FIGS. 10, 11, 13 and 14, at least one of the side walls 103 which define the bath chamber 77 is laterally displaced with respect to the corresponding wall 100 which defines part of the entrant passage 101. By this construction, therefore, at least the respective vertically spaced tiers of electrodes 79, 81, 83 and 85, on one side of the bath have been laterally displaced with respect to the entrant passage 101 and particularly with respect to the upright wall 100 of the entrant passage. This provides for an increased transverse dimension of the bath so that the current paths between the electrodes 79 ad 81 and 83 and 85 do not obstruct or interfere with maximum loading, as shown at W, FIG. 13.

In the illustration shown in FIGS. 10 and 11, the T-shaped electrodes are arranged in vertically spaced pairs upon opposite sides of the ceramic housing 35. The current paths on one side of chamber 77 are such that the current traveling through the bath will achieve uniform heating of the bath throughout its height, as demonstrated by the uniform temperature gradient graph shown in FIG. 17 established by testing the furnace shown in FIGS. 10 and 11.

The temperature gradient throughout the depth of the bath does not exceed 5 degrees F., plus or minus, with respect to the general temperature at the base of the bath of 2,200 degrees F., for illustration.

Figure 14:
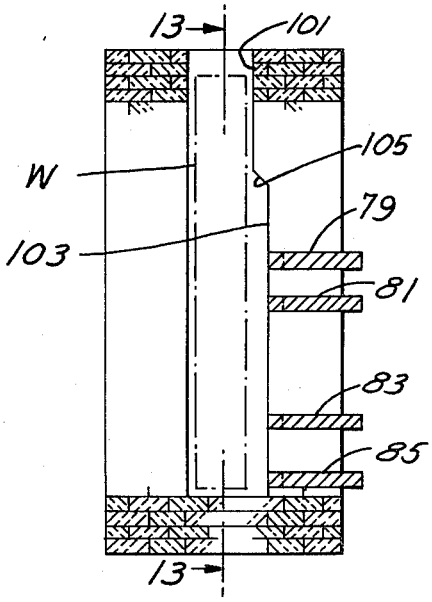
FIG. 14 is a similar view taken in the direction of arrows 14—14 of FIG. 13.

In the illustration shown in FIGS. 13 and 14, there are provided vertically spaced pairs of vertically spaced electrodes 79, 81, 83 and 85 which are arranged upon one side of the chamber 77 and extend throughout the height thereof and are arranged laterally outward of the one laterally displaced chamber defining side wall 103. This construction also provides for the use of a workpiece load W which extends throughout the height of the bath chamber and substantially throughout its lateral dimensions.

Figure 15:
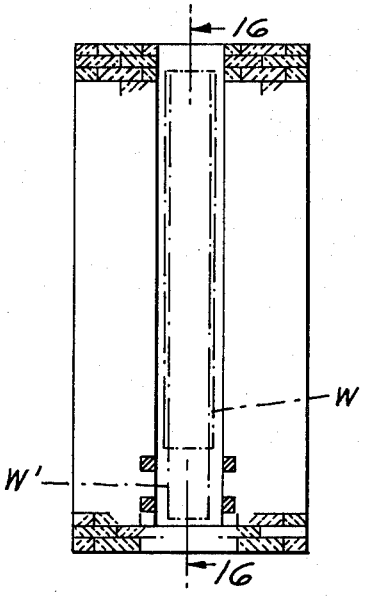
FIG. 15 PRIOR ART
FIG. 15 is a view similar to FIG. 13 of the housing of a prior art furnace with the electrodes arranged adjacent the bottom of the bath and limiting the length and diameter of the workpiece load, being taken in the direction of arrows 15—15 of FIG. 16.
Figure 16:
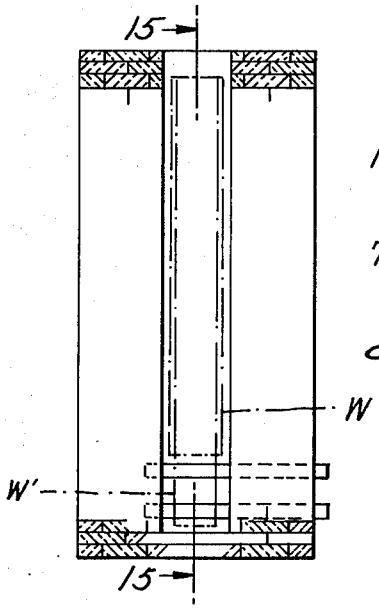
FIG. 16 PRIOR ART
FIG. 16 is a similar view taken in the direction of arrows 16—16 of FIG. 15.
Figure 18:
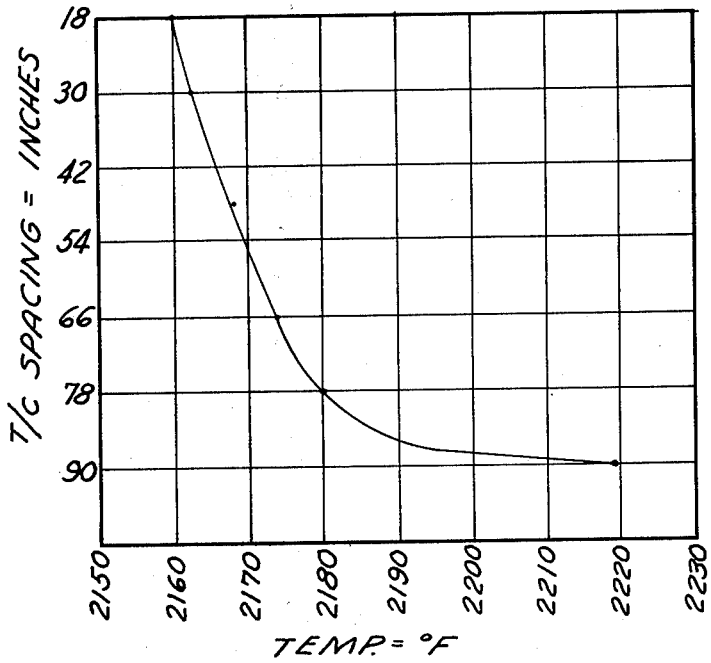
FIG. 18 PRIOR ART
FIG. 18 is a similar temperature gradient bath corresponding to the results obtained in the prior art salt bath housings shown in FIGS. 15 and 16.

The use of the tier of electrodes at the base of the ceramic housing, as shown in the prior art illustrations, FIGS. 15 and 16, provides a non-uniform temperature gradient throughout the depth of the bath and wherein, it appears, FIG. 18, that at the bottom of the bath, the heat treat temperature is 2,220 degrees F., whereas, adjacent the top thereof, the temperature has been reduced to 2,160 degrees F., approximately. Thus, there is a non-uniform temperature gradient of the bath between the bottom of the bath and the top thereof to thus achieve a non-uniform heat treat of the workpiece load W–W', such as shown in FIGS. 15 and 16.

Figure 17:
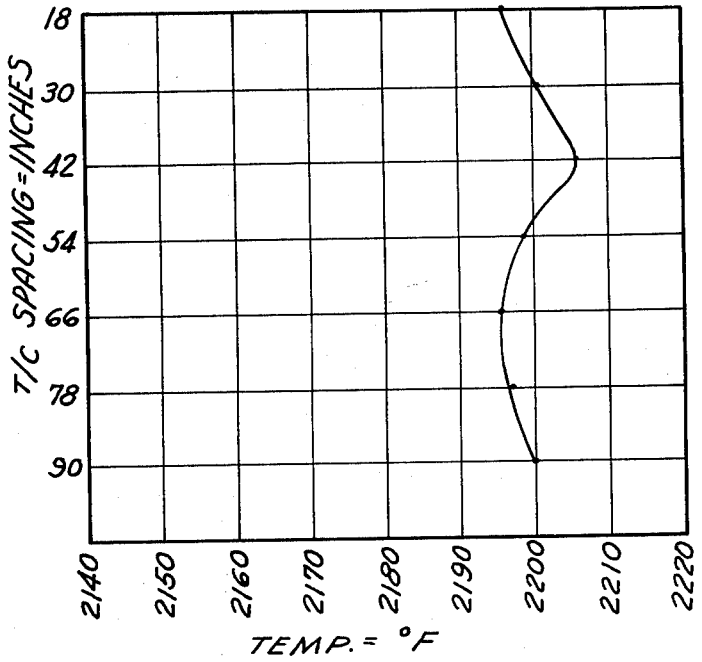
FIG. 17 is a temperature gradient bath corresponding to the modified heat treat furnace shown in FIGS. 10 and 11.

The uniform temperature graph in FIG. 17 demonstrates the substantial uniformity of bath temperature throughout the depth of the bath for the heat treat furnace shown in FIGS. 10 and 11 as well as the furnace shown in FIGS. 13 and 14.

In operation, only the vertically spaced tiers of electrodes at the right side of the housing, FIG. 11, are operative for maintaining a uniform bath temperature. Such tiers may wear out or later be disconnected. Then the opposing tiers of electrodes are activated, once strips 111 have been removed, in order to permit current flow through the bath between vertically spaced adjacent electrodes.

Having described my invention, reference should now be had to the following Claims.

I claim:

1. An electrically heated molten salt bath furnace comprising a frame having a base; an open top housing of ceramic brick enclosed within said frame and including an elongated chamber enclosed by first and second pairs of opposed and spaced apart side walls; said chamber throughout its height being of generally rectangular cross section and adapted to receive a molten salt bath into which metal workpieces are suspended for heat treatment; said housing having a top entrant passage of rectangular shape located directly above and in communication with said chamber, said top entrant passage having two pairs of parallel and spaced apart inner walls; the opposed and spaced apart side walls of said first pair being parallel to one another throughout their vertical extent from the top to the bottom of said chamber and extending in a first direction; the opposed and spaced apart side walls of said second pair extending in a second direction which is perpendicular to said first direction; at least one of the opposed and spaced apart side walls of said second pair being displaced outwardly of said entrant passage; a plurality of vertically spaced tiers of vertically spaced electrodes arranged in each side wall of said second pair along the height of said chamber intermediate its ends; said electrodes being laid in recesses extending in said second direction along the spaced apart side walls of said second pair; said electrodes each exposing only one face to the bath in said chamber and being located below the level of the molten salt bath for the passage of current through the bath between the electrodes of each tier for maintaining the bath at a predetermined heat treat temperature; transformer means having primary and secondary pads; electrical connectors between said transformer pads and electrodes respectively; said displaced side wall spacing the electrodes therein outwardly of said entrant passage, whereby the workpieces to be treated extend through said entrant passage and chamber to the bottom of said chamber, said tiers of electrodes maintaining a substantially uniform temperature gradient of said bath throughout the height of said chamber; said entrant passage spacing the workpieces inwardly of the electrodes in said displaced side wall of said second pair, so as not to obstruct current flow between the electrodes in each tier.

2. The electrically heated molten salt bath furnace defined in claim 1 wherein each of said side walls of said second pair are laterally displaced outwardly of said entrant passage.

3. The electrically heated molten salt bath furnace defined in claim 1 wherein said electrodes project outwardly of said housing; and blower means for circulating cooling air to said electrodes to remove heat therefrom.

4. The electrically heated molten salt bath furnace defined in claim 1 wherein one of the inner walls of one pair of inner walls of said entrant passage has at its lower end a wall portion which is inclined outwardly and downwardly and merges with said laterally displaced side wall of said chamber.

5. The electrically heated molten salt bath furance defined in claim 2 wherein the inner walls of said one pair of inner walls of said entrant passage have at their lower ends wall portions which are inclined outwardly and downwardly and merge with said laterally displaced side walls of said second pair of walls of said chamber respectively.

6. The electrically heated molten salt bath furnace defined in claim 1, wherein said transformer means includes a single transformer having primary and secondary pads, there being a first set of connectors between said primary pad and one electrode of each pair of vertically spaced electrodes; and a second set of connectors between said secondary pad and the other of each pair of said vertically spaced electrodes.

7. The electrically heated molten salt bath furnace defined in claim 1, wherein said transformer means includes a pair of transformers, each transformer having primary and secondary pads, there being connectors between the pads of one transformer and some of the vertically spaced electrodes; and additional connectors between the other transformer pads and the remaining electrodes.

8. The electrically heated molten salt bath furnace defined in claim 1 wherein each electrode in said other wall of said second pair has said one face thereof covered with a removable refractory layer embedded in the corresponding recess and extending the length thereof, said layer being removed prior to the use of the electrode in maintaining the bath at a predetermined temperature.

9. The electrically heated molten salt bath furnace defined in claim 1, wherein the salt bath temperature throughout the height of the bath in said chamber varying less than ±5 degrees, F.

* * * * *